US005235961A

United States Patent [19]

McShannon

[11] Patent Number: 5,235,961

[45] Date of Patent: Aug. 17, 1993

[54] CARBIDE TIP AND PICK

[75] Inventor: Gordon A. McShannon, Sheffield, England

[73] Assignee: Hydra Tools International plc, Sheffield, England

[21] Appl. No.: 781,855

[22] Filed: Oct. 24, 1991

[51] Int. Cl.[5] ..... B28D 1/26

[52] U.S. Cl. ..... 125/43; 299/79; 299/91; 175/426; 175/427; 407/42

[58] Field of Search ..... 407/42, 61, 118, 113, 407/114; 125/40, 42, 43; 299/79, 91, 92, 93; 175/427, 410, 426

[56] References Cited

U.S. PATENT DOCUMENTS

| | | | |
|---|---|---|---|
| 2,330,081 | 9/1945 | Phipps | 175/427 |
| 4,143,920 | 3/1979 | Haddock | 175/427 |
| 4,674,802 | 6/1982 | McKenna | 299/79 |
| 4,838,366 | 6/1989 | Jones | 175/426 |
| 5,092,310 | 3/1992 | Walen | 125/43 |

FOREIGN PATENT DOCUMENTS

| | | | |
|---|---|---|---|
| 1085757 | 10/1967 | United Kingdom | 299/79 |

*Primary Examiner*—Bruce M. Kisliuk
*Assistant Examiner*—Jack Lavinder
*Attorney, Agent, or Firm*—Trexler, Bushnell, Giangiorgi & Blackstone, Ltd.

[57] ABSTRACT

A carbide mineral cutting tip (5) comprises a solid carbide body having at least one front face (6), at least one top face (9), a bottom, seating face (12), a rear face (20), and side faces (13), the rear face (20) being provided at the end of an extended tail portion (15) of the tip (5), whereby the front- to-rear length (A to C) of the tip (5) approximates to twice the depth of the tip (5) represented by the top-to-bottom length (D to E) of the front face (6). The invention also includes a mineral cutter pick (1) provided with such a tip.

4 Claims, 2 Drawing Sheets

CARBIDE TIP AND PICK

Figure 1:
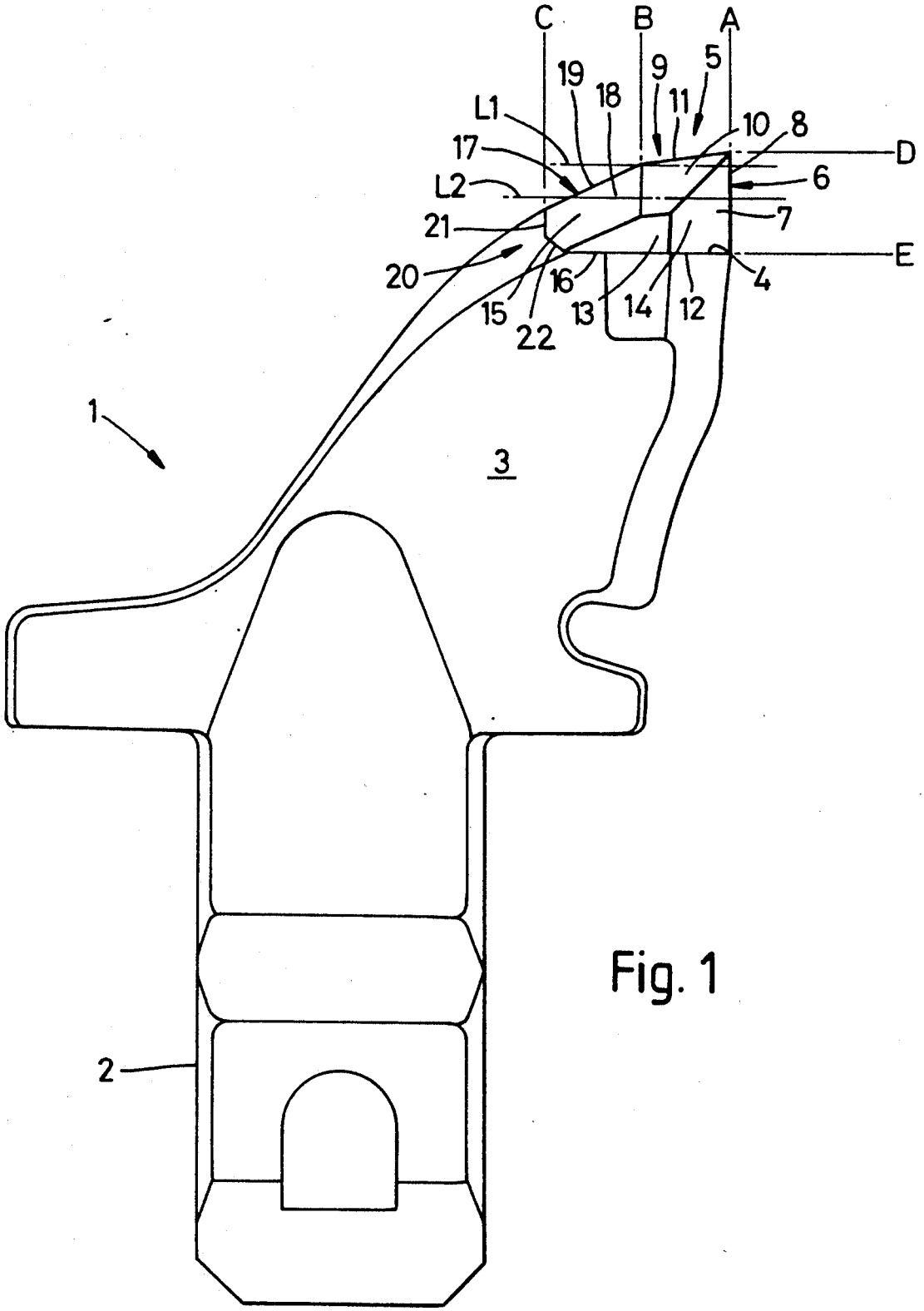

This invention relates to a carbide mineral cutting tip, and to a mineral cutter pick provided with such a tip.

In the winning of minerals such as coal, industry-standard cutter picks of various types, (such as radial picks, and forward attack picks), are established in extensive use, all being of steel, with a tip-receiving recess machined into the top, upper face of the head of the pick, and with a tip brazed in position in the recess. With industry-standard tip designs after some 10% to 20% of wear has occured on a top edge of the tip, the steel of the pick head is exposed, and disadvantageously begins a rubbing action on the mineral being mined and/or on rock overlying or underlying the mineral seam involved and disadvantageous quartz pick up occurs. More seriously, if coal is involved, release of methane as the seam is won frequently leads to spontaneous ignition at the so-called incendive sparking zone behind the tip due to the elevated temperature of the pick adjacent this zone, leading to the need for various ventilating and/or water quenching precautions, with attendant costs. Furthermore, early tip wear and diminished cutting efficiency leads to an early need for pick changing—typically after 3–4 shifts of coal mining is involved—requiring perhaps one hour down time to change a rotary cutting head having say 50 picks.

A basic object of the invention is to provide a carbide tip and mineral cutter pick of increased working life and diminished propensity for spark ignitions.

According to a first aspect of the invention there is provided, a carbide mineral cutting tip comprising solid carbide body having at least one front face, at least one top face, a bottom, seating face, a rear face, and side faces, the rear face being provided at the end of an extended tail portion of the tip, whereby the front-to-rear length of the tip approximates to twice the depth of the tip represented by the top-to-bottom length of the front face.

According to a second aspect of the present invention, there is provided a mineral cutter pick incorporating a tip as defined above.

Thus, with the tip and picks in accordance with the invention the tip is extended rearwardly so that its front to rear length is approximately twice that of an industry-standard tip. Tests have indicated that with the tip and pick in accordance with the invention at least 50% tip wear must occur before the steel of the pick head becomes exposed for steel-to-rock contact. Consequently, the pick life is extended by some 50%. Apart from reduced costs resulting from the reduced number of picks required to mine the same tonnage of mineral, added savings are provided by reducing down time by half for pick changing operations.

Preferably, the front face of the tip is defined by two angled faces converging to a front apex. The top face may similarly be defined by two faces converging to a top apex. The bottom seating face may be planar. With regard to the extended tail portion, this may also have a bottom, seating face contiguous with that of the main tip portion. It may also have a top face defined by two faces converging to a top apex contiguous with the top apex of the main tip portion but preferably at increased back clearance angle. The rear face may be defined by a first face parallel, or generally so, to the front face, and leading by a chamfered face to the bottom, seating face.

Clearly, the tip-receiving recess of the head of the pick in accordance with the second aspect needs to be machined to a profile to match that of the bottom, seating faces, and rear face(s) of the tip in accordance with the first aspect.

Figure 2:
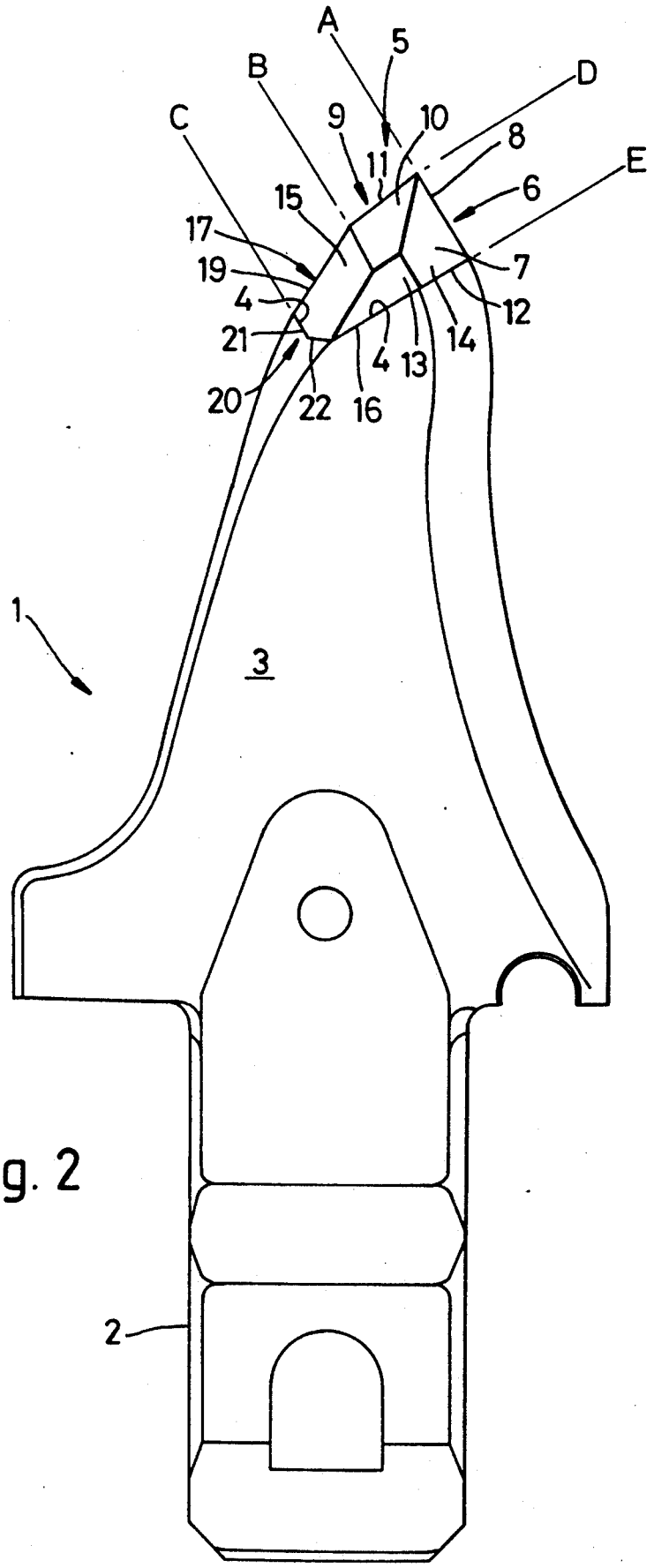

The invention will now be further described by way of examples, with reference to the accompanying drawings, in which:

FIG. 1 is a side elevation of a radial mineral cutter pick in accordance with the second aspect of the invention, provided with a carbide tip in accordance with the first aspect of the invention; and FIG. 2 corresponds to FIG. 1 but illustrates a forward attack pick.

In both figures, like components are accorded like reference numerals.

A mineral cutter pick 1 is of forged steel having a rectangular section shank 2 adapted to be received, releasable in an aperture of corresponding profile, of a pick box (not shown) secured by welding to a rotary cutting head of a mineral winning machine, e.g. a so-called shearer, or a tunnel or underground roadway driving machine, e.g. a so-called roadheader. This shank 2 is integral with an enlarged head 3 which may be offset, as shown in FIG. 1, to constitute an industry-standard radial pick, or may be generally in line, as shown in FIG. 2, to constitute an industry-standard forward attack pick.

Into the terminal end of the head 3 remote from the shank 2 is machined a generally "L"-shaped receiving recess 4 for a solid carbide tip 5.

The tip 5 has a front face 6 defined by two angled faces 7 converging to a front apex 8; has a top face 9 also defined by two faces 10 converging to a top apex 11; and has a planar, bottom seating face 12 and has lateral side faces 13. In the front-to-rear direction defined between lines A and B, is a main tip portion 14, which alone may be considered as an industry-standard tip, and when wear has occurred with such a tip, only as far as line L1 (FIG. 1), disadvantageous steel-to-mineral contact will occur between the head 2 and the mineral involved. In accordance with the first aspect of the invention, the tip 1 includes an extended tail portion 15 defined between lines B and C, so that the tip 1 has an overall front-to-rear length defined between lines A and C, which length A to C is approximately twice the depth of the tip 1 represented by the top-to-bottom length of the front face 6 defined between lines D and E. The portions 14 and 15 are of course integrally produced during conventional carbide pressing and sintering operations.

The extended tail portion 15 has a bottom seating face 16 contiguous with the face 12 of the main tip portion 14, and also has a top face 17 defined by two faces 18 converging to a top apex 19 contiguous with the top apex 11 of the main tip portion 14 but, as can be seen from FIGS. 1 and 2, of increased back rake angle. Finally, the extended tail portion 15 has a rear face 20 defined by a first face 21 parallel to the front face 6 of the main tip portion 14 and leading, by a chamfered face 22, to the bottom seating face 16.

Tests have shown that with the tip 1 in accordance with the invention, comprising a main tip portion 14 and an extended tail portion 15, no disadvantageous steel-to-mineral contact occurs until wear reaches line L2 (FIG. 1). With the tips 1 as illustrated, this means that some 50% of the carbide tip 1 must be worn away before the steel of the pick head becomes exposed for rock etc.

contact. This provides for a substantial extension of pick life by approximately 50% compared with picks provided with industry-standard forms of carbide tips; for a reduced number of pick changes and hence reduced non-productive labour costs and also reduced down time of the associated shearer or roadheader and hence increased production; for a reduced number of pick purchases for a mine operator; and for reduced underground transportation costs.

What I claim is:

1. A carbide mineral cutting tip comprising solid carbide body having at least one front edge defined by two angled front faces converging to an apex; at least one top face; a bottom, seating face; a rear face defined by a first fact parallel to said front edge and leading to said bottom seating face; and lateral side faces, said tip comprising a main tip portion and an extended tail portion, said rear face being provided at a terminal end of said extended tail portion of said tip, whereby a front-to-rear length of said tip approximates to twice the depth of said tip represented by the top-to-bottom length of said front edge, with two faces converging to an apex defining a top edge of said main tip portion, with two further faces converging to an apex defining edge of said extended tail portion, said top apex of said extended tail portion being contiguous with a top apex of said main tip portion, and said top apex of said extended tail portion having an increased back clearance angle compared with that of said top apex of said main tip portion said clearance angle being defined relative a plane orthogonal to said front edge.

2. A tip as claimed in claim 1, wherein said bottom seating face is planar.

3. A tip as claimed in claim 1, wherein said extended tail portion has a bottom seating face contiguous with said bottom seating face of said main tip portion.

4. A mineral cutter pick provided with a carbide tip comprising a solid carbide body having at least one front edge defined by two angled front faces converging to an apex; at least one top face; a bottom, seating face; a rear face defined by a first face parallel to said front edge and leading to said bottom seating face; and lateral side faces, said tip comprising a main tip portion and an extended tail portion, said rear face being provided at a terminal end of said extended tail portion of said tip, whereby a front-to-rear length of said tip approximates to twice the depth of said tip represented by the top-to-bottom length of said front edge, with two faces converging to an apex defining a top edge of said main tip portion, with two further faces converging to an apex defining edge of said extended tail portion, said top apex of said extended tail portion being contiguous with a top apex of said main tip portion, and said top apex of said extended tail portion having an increased back clearance angle compared with that of said top apex of said main tip portion said clearance angle being defined relative a plane orthogonal to said front edge.

* * * * *